US006522852B1

(12) United States Patent
Tsubuko et al.

(10) Patent No.: US 6,522,852 B1
(45) Date of Patent: Feb. 18, 2003

(54) IMAGE FORMING PROCESS USING WET DEVELOPING METHOD

(75) Inventors: Kazuo Tsubuko, Shizuoka-ken (JP); Tuyoshi Asami, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 403 days.

(21) Appl. No.: 09/099,078

(22) Filed: Jun. 16, 1998

(30) Foreign Application Priority Data

Jun. 16, 1997 (JP) ..... 9-172764
Jun. 2, 1998 (JP) ..... 10-167806

(51) Int. Cl.[7] ..... G03G 15/10; G03G 15/16
(52) U.S. Cl. ..... 399/240; 399/249; 399/308
(58) Field of Search ..... 399/222, 223, 399/233, 237, 239, 240, 249, 298, 302, 308

(56) References Cited

U.S. PATENT DOCUMENTS 4,720,731 A * 1/1988 Suzuki et al. ..... 399/239
4,796,048 A * 1/1989 Bean ..... 399/308
5,285,244 A * 2/1994 Bujese ..... 399/249
5,300,990 A * 4/1994 Thompson ..... 399/240
5,640,655 A * 6/1997 Shoji ..... 399/249
5,666,616 A * 9/1997 Yoshino et al. ..... 399/240
5,715,510 A * 2/1998 Kusaba et al. ..... 399/308
5,774,775 A * 6/1998 Aoto et al. ..... 399/308
5,815,779 A * 9/1998 Abramsohn ..... 399/249
5,835,826 A * 11/1998 Okada et al. ..... 399/249

* cited by examiner

*Primary Examiner*—Sandra Brase
(74) *Attorney, Agent, or Firm*—Oblon, Spivak, McClelland, Maier & Neustadt, P.C.

(57) ABSTRACT

An image forming process wherein a latent image-bearing surface of a supporting member is contacted with a toner-containing liquid developer to develop the latent image with the liquid developer and to form a toner image covered with a layer of the liquid developer. The toner image-bearing surface is treated with a squeezing member to squeeze the liquid developer layer therefrom. The toner image-bearing surface is then treated with a voltage impressing member to impart a bias voltage to the toner image. The toner image is transferred from the surface to an intermediate transfer medium and then to a transfer medium.

10 Claims, 4 Drawing Sheets

IMAGE FORMING PROCESS USING WET DEVELOPING METHOD

BACKGROUND OF THE INVENTION

This invention relates to an image forming process and, more specifically, to a full color image forming process.

In electrophotography and electrostatic recording or printing, there are known a wet developing method in which a liquid developer is used for developing a latent image and a dry developing method in which a powder developer is used for developing a latent image. Because the powder developer generally has a coarse particle size of as high as about 7 μm, the dry developing method has a limitation in obtaining very fine images. On the other hand, the liquid developer uses developing particles with a diameter of 2 μm or less, generally 1 μm or less, fine, high quality images can be obtained. Because of this advantage, an attention is now again being paid upon the wet developing method. Namely, the developer for use in the wet developing method is composed of a color fine powder (toner particles) dispersed in an electrically insulating organic solvent. Since the particle size of the toner particle is very fine, the reproducibility of fine line images is much improved as compared with that attained by the dry developing method. Such an advantage as well as high resolution, contrast and gradient are also obtainable in the development of a full color images obtained by using yellow, magenta, cyan and black toners.

With a view toward improving copying speed while retaining the above advantages of the liquid developer, U.S. Pat. No. 4,945,387 and U.S. Pat. No. 4,984,025 suggest an image forming method using an intermediate image transfer medium. The use of the intermediate image transfer medium has an additional merit that toner images can be transferred not only a sheet like transfer medium such as paper but also other transfer media. The known methods adopting an electrostatic transfer system, however, still has a limitation in obtaining high quality copies at a high speed.

U.S. Pat. No. 4,708,406 proposes a method in which a toner image on an image supporting roller is transferred to an intermediate transfer medium in the form of a belt or a roller by pressure contact therebetween. In this method, however, the transfer efficiency is not satisfactory so that the quality of the copy image is not fully satisfactory.

International Publication No. WO90/05942 discloses a method in which a toner image on an intermediate image transfer medium is heated to impart adhesiveness thereto and to improve the transfer efficiency and fixation efficiency. This method, however, causes deterioration of the toner image on the intermediate image transfer medium due to heat applied thereto, so that reliable images are not obtainable.

In a wet developing method, it is known that a sharp image having good resolution may be obtained by previously charging a toner image on a photosensitive image supporting member prior to the image transfer. Such an improvement in sharpness is considered to be attained by the following mechanism.

Referring to FIG. 4, designated as 1 is a photosensitive image supporting member having a developing liquid layer 2 in which an image of toner particles 3 has been just developed. Each toner particle is composed of a pigment 5 and a resin layer 6 surrounding the pigment 5. The toner image is not tightly bound to the supporting member 1 because the toner particles 3 are in a swelled state. As a consequence, when the toner image-bearing supporting member 1 is brought into pressure contact with a transfer paper, the toner image is deformed so that a sharp image is not obtainable.

When the toner image-bearing supporting member is charged prior to the image transfer, the toner particles 3 are tightly bound to the supporting member 1 as shown in FIG. 5. As a consequence, the toner image is able to be transferred to a transfer paper without being disturbed or spread, so that a sharp image is obtainable.

It has been found, however, that the above previous charging system gives a high quality image only when a high quality transfer paper having a smoothness of 100 seconds or more is used. In particular, when a transfer paper having a smoothness of 60 seconds or less is used, a uniform solid pattern is not obtainable. Namely, the concentration (density) of the solid pattern is not uniform. Moreover, image density and sharpness are not satisfactory when a low grade transfer paper is used.

SUMMARY OF THE INVENTION

It is, therefore, an object of the present invention to provide an image forming process which can give uniform solid pattern on a transfer medium even when the surface smoothness of the transfer paper is not good.

Another object of the present invention is to provide an image forming process of the above-mentioned type which can give images having excellent sharpness.

It is a further object of the present invention to provide an image forming process of the above-mentioned type which can give images having a high density and high resolution.

In accomplishing the foregoing objects, there is provided in accordance with the present invention an image forming process comprising the steps of:

(a) contacting a latent image-bearing surface of a supporting member with a toner-containing liquid developer to develop said latent image with said liquid developer and to form a toner image covered with a layer of said liquid developer;

(b) treating said toner image-bearing surface with a squeezing member to squeeze said liquid developer layer therefrom;

(c) then treating said toner image-bearing surface with a voltage impressing member to impart a bias voltage to said toner image;

(d) then transferring said toner image from said surface to an intermediate transfer medium; and (e) then transferring said transferred toner image from said intermediate transfer medium to a transfer medium.

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
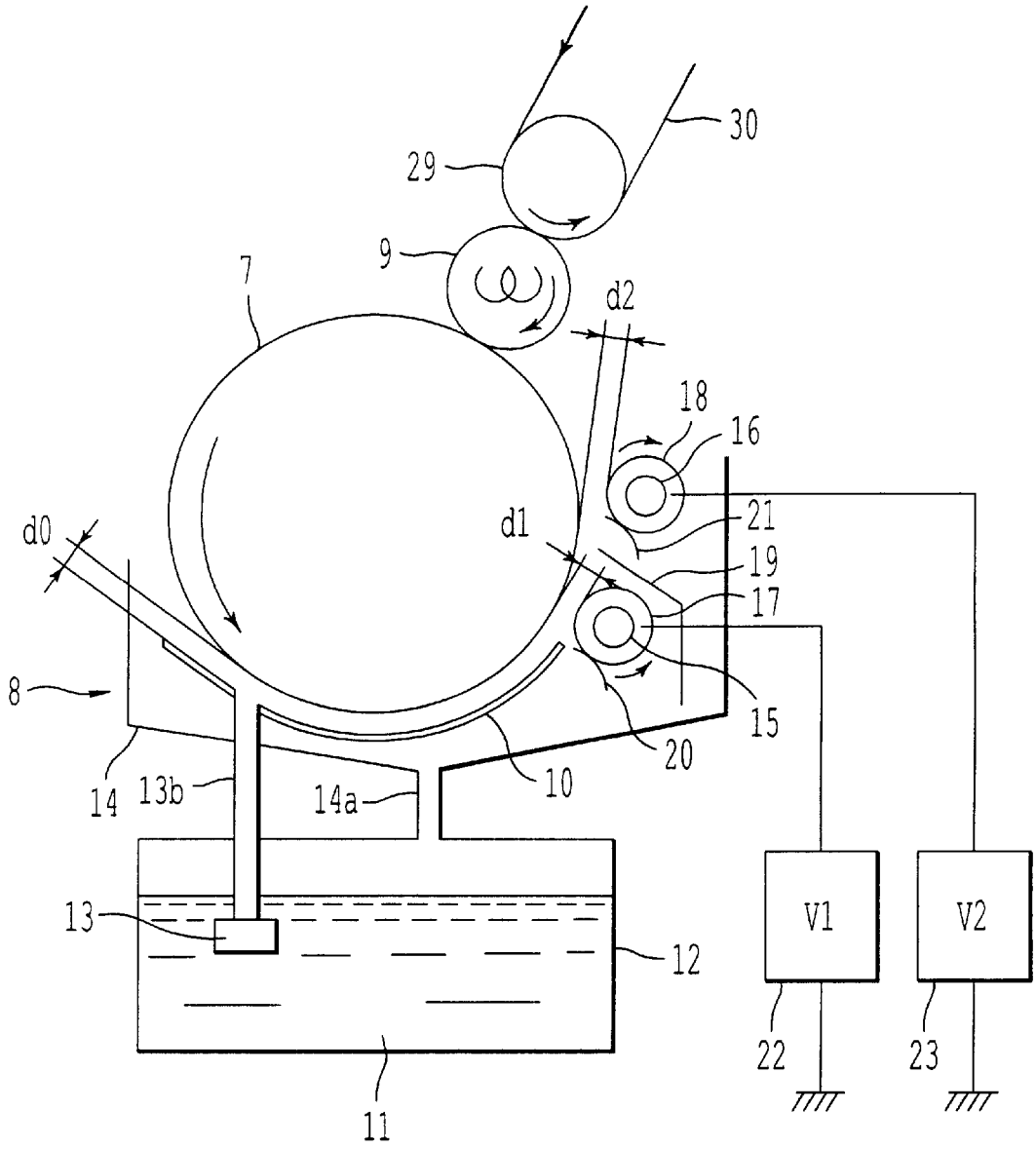
FIG. 1 is an elevational view diagrammatically illustrating an embodiment of an image forming apparatus suitable for carrying out the process according to the present invention.

In the image forming process according to the present invention, an electrostatic latent image is formed on a surface of a supporting member by any known manner such as by charging and exposure. The latent image-bearing surface is then contacted with a liquid developer containing toner particles having a polarity opposite the electrostatic latent image to convert the latent image to a toner image therewith by electrophoresis of the toner, so that the surface has a toner image covered with a layer of the liquid developer.

The supporting member may be, for example, a drum having a peripheral surface of an organic or inorganic photosensitive material such as cadmium sulfide, amorphous silicon or selenium.

For reasons of improved image reproducibility, it is preferred that a grounded conductor (developing electrode) be disposed adjacent the supporting member. Such a developing electrode is preferably a cylindrical roller rotating in the direction opposite the rotating direction of the supporting member. The cylindrical developing roller can serve to function not only as an electrode but also to partly remove or squeeze the liquid developer which covers the toner image.

The toner image-bearing surface is then treated with a squeezing member to squeeze the liquid developer layer covering the toner image. The squeezing member is preferably a roller rotating in the same direction as the rotating direction of the supporting member.

The toner image-bearing surface from which the liquid developer layer has been removed by the squeezing member is then treated with a voltage impressing member to impart a bias voltage to the toner image. The voltage impressing member is preferably a voltage impressing roller disposed adjacent the.e supporting member with a gap being defined therebetween for reasons of improving uniformity of final solid pattern images. The gap is preferably greater than a space between the toner image-bearing surface of the supporting member and the squeezing roller, because of the prevention of the formation of background stains by the voltage impressing roller. It is preferred that the voltage impressing roller be rotated in a direction opposite the rotating direction of the squeezing roller for reasons of precise transference of the toner image.

The voltage impression is preferably conducted such that the toner image-bearing surface is impressed with a voltage of a polarity opposite the polarity of the toner image to permit a discharge current of 1–100 $\mu$A to flow between the voltage impressing member and the toner image-bearing surface. By this expedience, the resolution of images can be improved.

The toner image thus treated with the voltage impressing member is then transferred from the supporting member to an intermediate transfer medium.

As a result of the voltage impression, the toner particles constituting the toner image are tightly bound to the surface of the supporting member so that the toner image is not spread when contacted with the intermediate transfer medium. Thus, the transferred image has high sharpness and high concentration.

The intermediate transfer medium preferably has a surface made of water and oil repellency. It is preferred that the intermediate transfer medium have a surface with a contact angle with water of 3° to 180°, more preferably 5°–90° for reasons of prevention of the deposition of the liquid developer thereon. The contact angle, herein, is as measured with Kyowa Contact Angle Meter CA-D manufactured by Kyowa Kagaku Kabsushiki Kaisha. Illustrative of suitable surface materials for the intermediate transfer medium are polyvinyl chloride, silicone rubber, fluorine rubber, polyvinylidene chloride, polyethylene terephthalate and mixtures or combinations thereof.

The image transfer may be carried out in any known manner by utilizing, for example, pressure, heat, electrostatic force or a combination thereof.

The toner image transferred to the intermediate transfer medium is then transferred to a transfer medium such as a paper in any known manner by utilizing, for example, pressure, heat, electrostatic force, flush light or a combination thereof.

In the process according to the present invention, any liquid developer may be used for the purpose of the present invention. The liquid developer generally contains a coloring agent, a dispersing medium, a resin and, optionally, a polarity controlling agent.

Any coloring agent may be used for the purpose of the present invention. For reasons of high image density and image resolution (sharpness), however, it is preferred that a disazo yellow pigment be used as a yellow coloring agent, a carmine or quinacridone pigment be used as a magenta coloring agent, a phthalocyanine pigment be used as a cyan coloring agent, and carbon black be used as a black coloring agent. The use of these coloring agents is also desirable for any known image forming method other than the process of the present invention.

Illustrative of suitable disazo yellow coloring agents are Pigment Yellow 12, Pigment Yellow 13, Pigment yellow 14, Pigment Yellow 17, Pigment Yellow 55, Pigment Yellow 81 and Pigment Yellow 83.

Illustrative of suitable carmine coloring agents are Pigment Red 5, Pigment Red 57, Pigment Red 60, Pigment Red 114, Pigment Red 147 and Pigment Red 185. Illustrative of suitable quinacridone coloring agents are Pigment Red 122 and Pigment Red 209.

Illustrative of suitable phthalocyanine coloring agents are Pigment Blue 15:1 (a-phthalocyanine), Pigment Blue 15:3, Pigment Blue 15:4, Pigment Blue 15:6 and Pigment Blue 16.

Especially preferred is the use of the following disazo yellow, carmine and phthalocyanine coloring agents.

Disazo Yellow Pigment:

No. 1 -1: compound of the following formula (I)

(I)

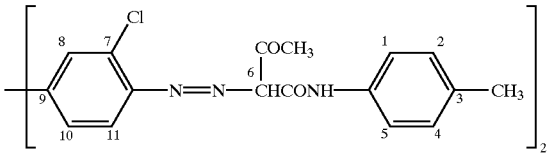

No. 1-2: compound of the formula (I) in which —H at position 1 is substituted by —$OCH_3$, No. 1-3: compound of the formula (I) in which —H at position 1 is substituted by —$OCH_3$and —Cl at position 7 is substituted by —$OCH_3$, No. 1-4: compound of the formula (I) in which —H at position 10 is substituted by —Cl, No. 1-5: compound of the formula (I) in which —$CH_3$ at position 3 is substituted by —$C_2H_5$, No. 1-6: compound of the formula (I) in which —$CH_3$, at position 3 is substituted by —$C_4H_9$, No. 1-7: compound of the formula (I) in which —$COCH_3$ at position 6 is substituted by —$COC_2H_5$, No. 1-8: compound of the formula (I) in which —$COCH_3$ at position 6 is substituted by —$COC_4H_9$ , and No. 1-9: compound of the formula (I) in which —H at position 5 is substituted by —COOH.

Carmine Pigment:

No. 2-1: compound of the following formula (II)

(II)

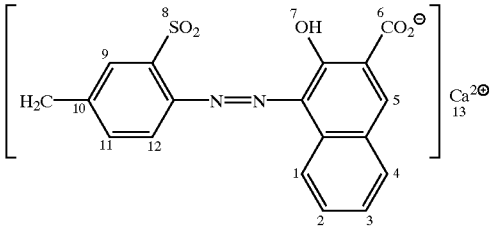

No. 2-2: compound of the formula (II) in which —H at position 2 is substituted by —OH and —H at position 11 is substituted by —OH, No. 2-3: compound of the formula (II) in which —H at position 2 is substituted by —COOH, No. 2-4: compound of the formula (II) in which —H at position 1 is substituted by —$CH_3$, No. 2-5: compound of the formula (II) in which —$CH_3$ at position 10 is substituted by —$OCH_3$ and —H at position 2 is substituted by —OH, No. 2-6: compound of the formula (II) in which —H at position 12 is substituted by —OH and —H at position 4 is substituted by —$CH_3$, No. 2-7: compound of the formula (II) in which which —H at position 2 is substituted by —OH, —H at position 11 is substituted by —OH and $Ca^2$+at position 13 is substituted by $Ba^2$+, No. 2-8: compound of the formula (II) On which —H at position 2 is substituted by —COOH and $Ca^2$+at position 13 is substituted by $Zn^2$+, and No. 2-9: compound of the formula (II) in which —$CH_3$ at position 10 is substituted by —$OCH_3$, —H at position 2 is substituted by —OH and $Ca^2$ +at position 13 is substituted by $Zn^2$+.

Phthalocyanine Pigment:

(III)

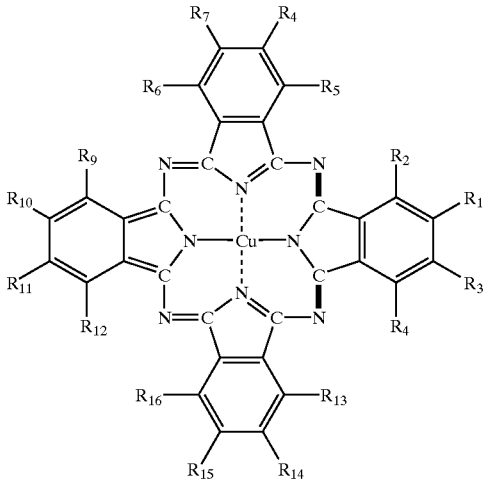

No. 3-1: compound of the above formula (III) in which $R_1$ and $R_{14}$ are each Cl and $R_2$–$R_{13}$, $R_{15}$ and $R_{16}$ are each H, No. 3-2: compound of the above formula (III) in which $R_1$ and $R_{14}$ are each Br and $R_2$–$R_{13}$, $R_{15}$ and $R_{16}$, are each H, No. 3-3: compound of the above formula (III) in which $R_1$, $R_6$, $R_{,12}$ and $R_{14}$ are each Cl and $R_2$–$R_5$, $R_7$–$R_{11}$, $R_{13}$ $R_{15}$ and $R_{16}$ are each H, No. 3-4: compound of the above formula (III) in which $R_1$ and $R_{14}$ are each Cl, $R_2$–$R_{13}$, $R_{15}$ and $R_{16}$ are each H and Cu is substituted by Zn, No. 3-5: compound of the above formula (III) in which $R_1$ and $R_{14}$ are each Br, $R_2$–$R_{13}$, $R_{15}$ and $R_{16}$ are each H and Cu is substituted by Ca, No. 3-6: compound of the above formula (III) in which $R_1$, $R_6$, $R_{12}$ and $R_{14}$are each Cl, $R_2$–$R_5$ , $R_7$–$R_{11}$ , $R_{13}$ $R_{15}$ and $R_{16}$ are each H and Cu is substituted by Ba, No. 3-7: compound of the above formula (III) in which $R_1$, $R_6$, $R_{10}$ and $R_{14}$ are each $OCH_3$ and $R_2$–$R_5$ , $R_7$–$R_9$, $R_{11}$–$R_{13}$, $R_{15}$ and $R_{16}$ are each H, and No. 3-8: compound of the above formula (III) in which $R_1$, $R_6$, $R_{10}$ and $R_{14}$ are each $OC_2H_5$ and $R_2$–$R_5$, $R_7$–$R_9$, $R_{11}$–$R_{13}$, $R_{15}$ and $R_{16}$ are each H.

As a coloring agent, an azo dye represented by the following formula (IV) or (V) may also be used:

(IV)

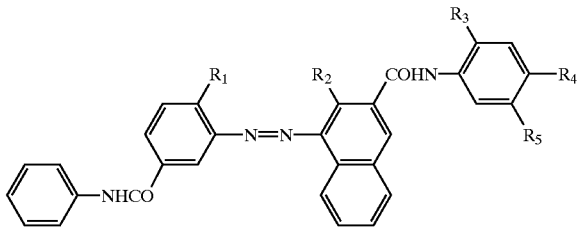

-continued (V)

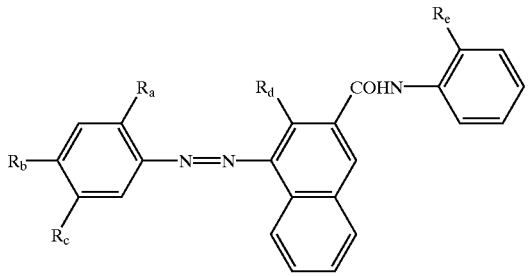

wherein $R_1$, $R_2$, $R_3$, $R_4$, $R_5$, $R_a$, $R_b$, $R_c$, $R_d$ and $R_e$ represent, independently from each other, a hydrogen atom, a halogen atom, a hydroxyl group, a lower alkyl group or a lower alkoxyl group. Suitable lower alkyl and alkoxyl groups are those represented by $—C_nH_{2n+}1$ and $—OC_nH_{2n+}1$ , respectively, where n is an integer of 1–4.

Illustrative of suitable azo dyes of the formula (IV) are as shown in Table 1 below.

TABLE 1

| Compound No. | $R_1$ | $R_2$ | $R_3$ | $R_4$ | $R_5$ |
|---|---|---|---|---|---|
| 4-1 | $OCH_3$ | OH | Cl | Cl | Cl |
| 4-2 | $OCH_3$ | OH | $OCH_3$ | Cl | $OCH_3$ |
| 4-3 | $OC_2H_5$ | OH | $OC_2H_5$ | Cl | Cl |
| 4-4 | $OC_2H_5$ | $OCH_3$ | $OCH_3$ | Cl | $CH_3$ |
| 4-5 | $CH_3$ | H | $CH_3$ | $CH_3$ | $CH_3$ |
| 4-6 | $C_2H_5$ | OH | $OCH_3$ | $C_2H_5$ | $C_2H_5$ |
| 4-7 | $OCH_3$ | OH | $C_2H_5$ | $CH_3$ | $CH_3$ |
| 4-8 | $OCH_3$ | $CH_3$ | OH | OH | OH |
| 4-9 | $OCH_3$ | OH | $OCH_3$ | Br | $OCH_3$ |
| 4-10 | $OCH_3$ | OH | $OCH_3$ | Cl | OH |

Illustrative of suitable azo dyes of the formula (V) are as shown in Table 2 below.

TABLE 2

| Compound No. | $R_a$ | $R_b$ | $R_c$ | $R_d$ | $R_e$ |
|---|---|---|---|---|---|
| 5-1 | Cl | Cl | Cl | $CH_3$ | $CH_3$ |
| 5-2 | Cl | Cl | Cl | OH | $CH_3$ |
| 5-3 | Cl | Cl | Cl | OH | $C_2H_5$ |
| 5-4 | Cl | Cl | Cl | $OCH_3$ | $CH_3$ |
| 5-5 | Cl | Cl | Cl | $OC_2H_5$ | $C_2H_5$ |
| 5-6 | $CH_3$ | $CH_3$ | $CH_3$ | OH | $CH_3$ |
| 5-7 | $CH_3$ | $CH_3$ | $CH_3$ | $OCH_3$ | $OCH_3$ |
| 5-8 | Br | Br | Br | OH | $CH_3$ |
| 5-9 | $C_2H_5$ | $C_2H_5$ | $C_2H_5$ | OH | $CH_3$ |
| 5-10 | Cl | Cl | Cl | OH | Cl |

As the dispersing medium of the liquid developer, there may be used, for example, a hydrocarbon such as n-hexane, isododecane or ISOBAR H, G, L or M (trademark, products of Exxon Inc.) a silicone oil such as KF995, KF994, KFB5, KF96-3000C (products of Shin-etsu Chemical Inc.) and/or an ester such as isobutyl myristate or isopropyl myristate.

As the resin which may serve to function as a dispersing agent, a polarity controlling agent and/or an image fixation agent, there may be mentioned a rosin-modified resin, an acrylic resin, a methacrylic resin, a polyolefin resin, an olefin copolymer resin, a polyurethane resin, a polyester resin, a silicone resin and an epoxy resin. The resin is generally used in an amount of 0.1–20 parts by weight, preferably 0.5–01 parts by weight, per part by weight of the coloring agent.

The liquid developer may optionally contain a polarity controlling agent such as metallic soap or lecithin.

The liquid developer may be prepared by mixing the above ingredients using an attritor, a Kedy mill, a bead mill or a ball mill to form a dispersion. For reasons of uniformity of the dispersion and coating of the coloring agent with the resin, it is preferred that the coloring agent and the resin be first integrated with each other by, for example, a flushing method or a kneading method and then dispersed in the dispersing medium using, for example, a medium mill. In this case, the dispersing medium and the polarity controlling agent may be present in the integration step. The toner in the liquid developer generally has an average article diameter of 20 $\mu$m or less, preferably 0.1–3 $\mu$m.

The coloring agents specifically described above may be used not only as a liquid developer but also as a dry toner of a single or two components type for a dry developing method. In the dry toner, no dispersing medium is used. The coloring agent is used in an amount of 0.01–3 parts by weight per part by weight of the resin. A small amount of a polarity controlling agent may be used. These ingredients are heated and kneaded into particles having a particle diameter of 3–10 $\mu$m.

The process of the present invention will now be described in more detail with reference to the drawings. Referring to FIG. 1, designated as 7 is a supporting member in the form of a rotatable photosensitive drum. The drum 7 is adapted to bear an electrostatic latent image which is formed in a charging and image exposure zone (not shown).

Disposed adjacent the drum 7 is a developing zone 8 having a tray 14 within which a lower part of the drum 7 is accommodated. A developing electrode 10 is disposed within the tray 14 and extends along a lower periphery of (generally coaxially with) the drum 7 with a space $d_0$ which is generally 0.6–1.0 $\mu$m. The tray 14 is in fluid communication with a vessel 12 through a return passage 14*a*. The vessel contains a liquid developer 11 which is fed by a pump 13 to the space between the electrode 10 and the drum 7 through a feed passage 13*b*. As a result of the above construction, the liquid developer 11 is fed, upon the operation of the pump 13, to the space above the electrode and is contacted with the latent image bearing surface of the rotating drum 7, so that the latent image is developed to form a toner image. The liquid developer overflowing the electrode 10 is received by the tray 14 and is returned to the vessel 12 through the passage 14*a*.

Disposed downstream of the electrode 10 and within the tray 14 is a squeezing roller 17 rotating at a revolution speed of 100–400 rpm in the same direction as the rotational direction of the drum 7. The squeezing roller 17 extends in parallel with the axis of the drum 7 and is rotatably received by bearings 15 capable of adjusting the gap $d_1$ between the drum 7 and the squeezing roller 17 within the range of 50–100 $\mu$m.

When the toner image bearing surface of the drum 7 is introduced into the gap, the developing liquid covering the toner image is squeezed and removed therefrom. Designated as 20 is a blade engaged by-the squeezing roller 17 to remove the developing liquid depositing thereon. A DC source 22 is electrically connected to the squeezing roller 17 to impart a bias voltage $V_1$ thereto.

Disposed downstream of the squeezing roller 17 and within the tray 14 is a voltage impressing roller 18 rotating at a revolution speed of 100–400 rpm in the direction opposite the rotational direction of the squeezing roller 17. The voltage impressing roller 18 extends in parallel with the axis of the drum 7. It is preferred that the voltage impressing roller 18 be spaced apart from the drum 7 with a gap $d_2$ which is preferably 100–200 $\mu$m and is, more preferably, a value greater than $d_1$. Thus, the roller 18 is rotatably received by bearings 16 capable of adjusting the gap $d_2$. A voltage source 23 is electrically connected to the voltage impressing roller 18 to impart a bias voltage $V_2$ thereto. The impressed voltage is generally 500–5,000 V, preferably 1,000–2,000 V. Designated as 21 is a blade for cleaning the voltage impressing roller 18.

The squeezing roller 17 and the voltage impressing roller 18 are preferably made of a hard alumite. Designated as 19 is a partition plate to prevent the roller 17 from contacting with the developing liquid falling from the roller 18.

When the photosensitive drum 7 is charged with a potential of +1,000 V to +1,300 V, for example, the bias voltage $V_2$ in the voltage impressing roller 18 is preferably −200 V to 0 V. In this case, the squeezing roller 17 is in a floating state. It is also preferred that a discharge current of 1–100 $\mu$A be flow between the voltage impressing roller 18 and the drum 7. By impressing a bias voltage to the voltage impressing roller 18, the toner particles constituting the toner image are tightly bound to each other and to the surface of the drum 7, the toner image is not spread upon Contact with an intermediate transfer medium 9.

The intermediate transfer medium 9 in the illustrated embodiment is in the form of heating roller and is also engaged by a transfer roller 29. A transfer medium such as a paper 30 is nipped between the rollers 9 and 29 so that the toner image on the drum 7 is transferred through the intermediate roller to the paper 30 with the aid of the heat of the rollers 9 and 29.

Figure 2:
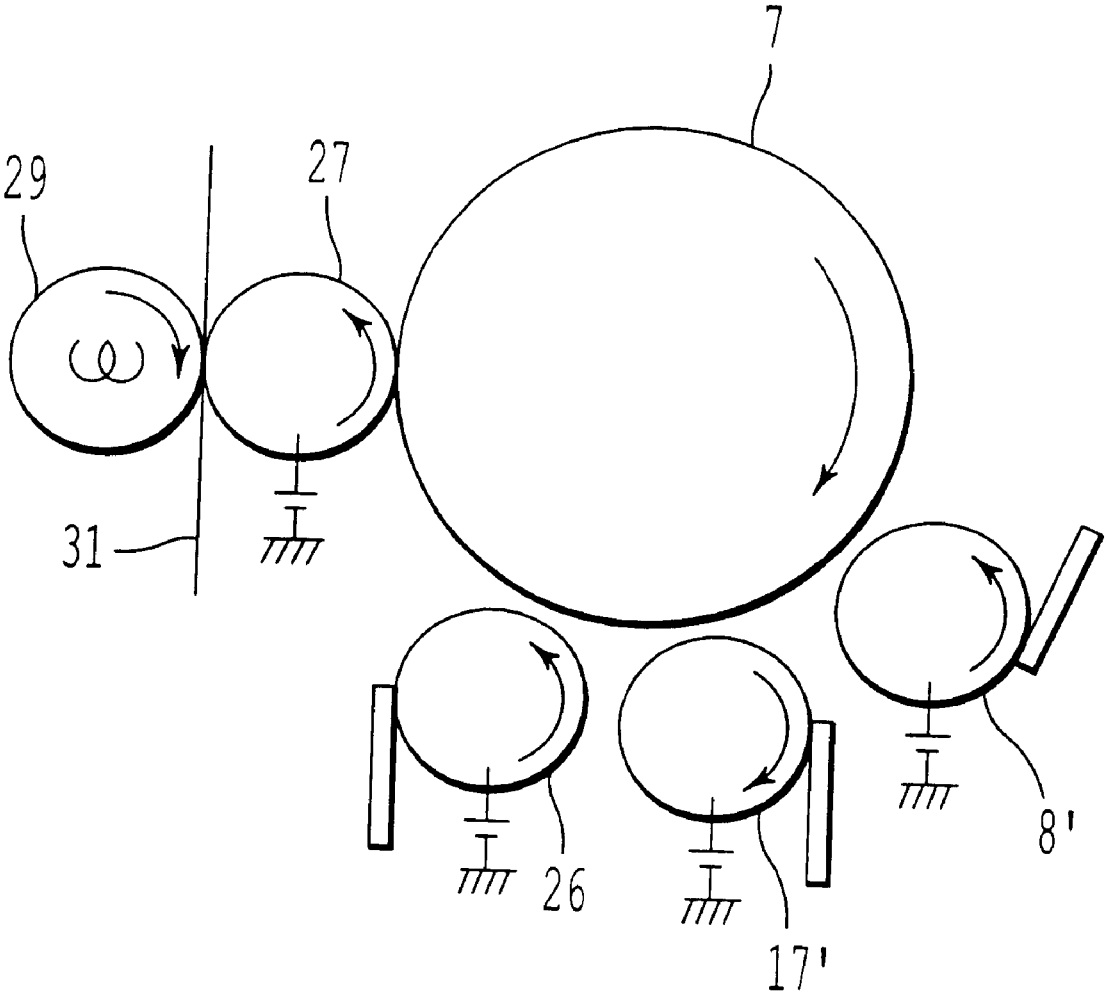
FIG. 2 is an elevational view diagrammatically illustrating another embodiment of an image forming apparatus suitable for carrying out the process according to the present invention.

FIG. 2 depicts another image forming apparatus suitably used for carrying out the process of the present invention. A developing roller 8', a squeezing roller 17', a voltage impressing roller 26 and an intermediate transfer roller 27 are disposed adjacent the periphery of a photosensitive drum 7 and rotatable as shown by the arrows. In FIG. 2, a vessel for containing a developing liquid and associated parts thereof are not illustrated for the purpose of simplicity. The developing roller 8' is dipped in the developing liquid and applies the liquid onto a latent image-bearing surface of the drum 7 for developing the latent image into a toner image. The squeezing roller 17', voltage impressing roller 26 and intermediate transfer roller 27 function in the same manner as those in the above-described embodiment shown in FIG. 1, so that a toner image on the drum 7 is transferred to the intermediate transfer roller 27 and then to a transfer medium 31 by a heat roller 29. The heat roller 29 may be substituted by a corona discharge device so that the image transfer is effected by an electrostatic force rather than by heat.

Figure 3:
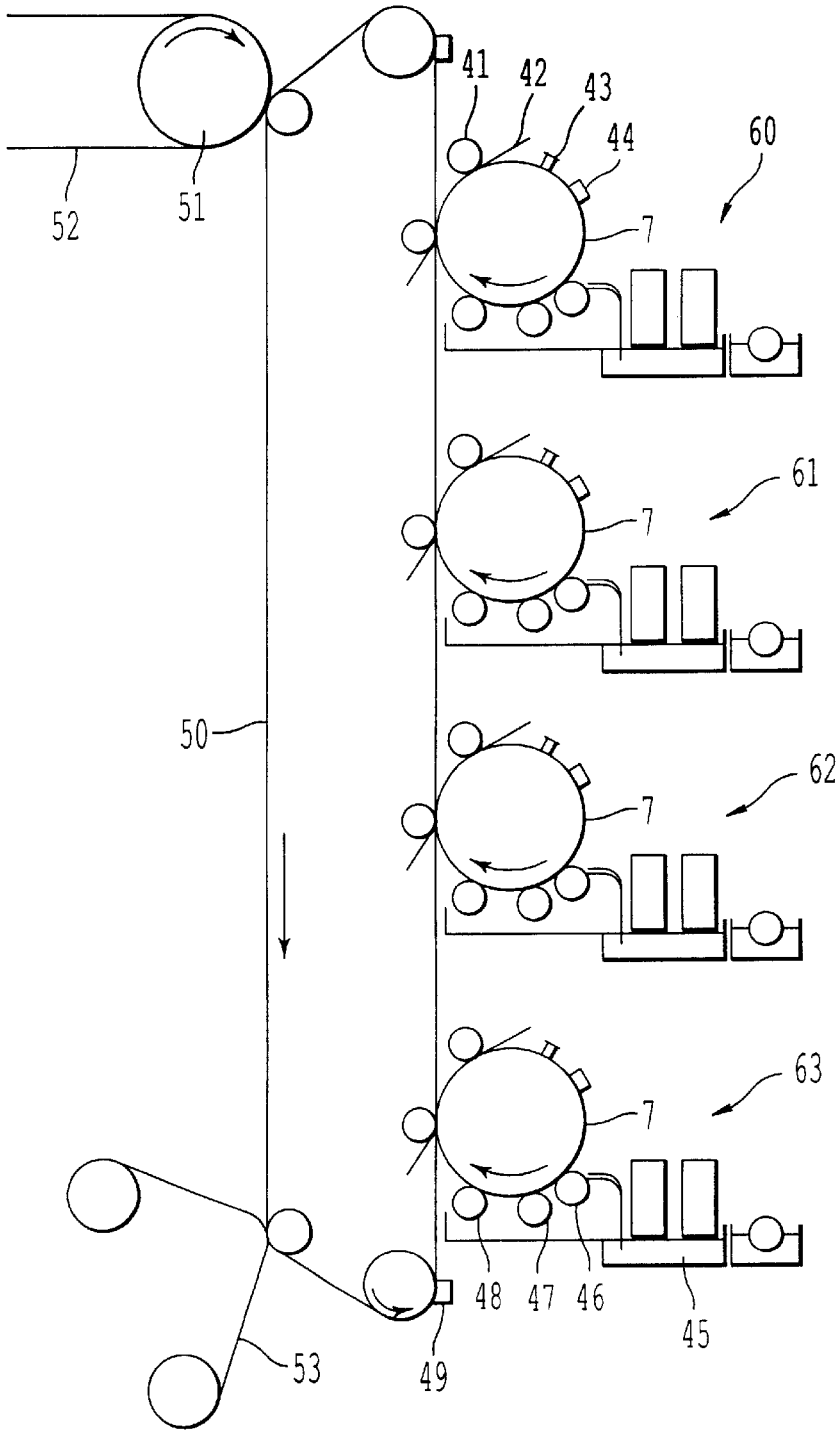
FIG. 3 is an elevational view diagrammatically illustrating a further embodiment of an image forming apparatus suitable for carrying out the process according to the present invention.
Figure 4:
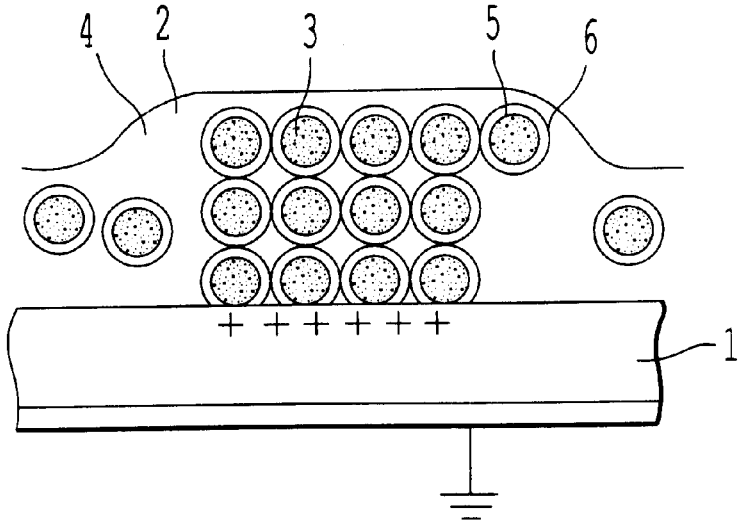
FIG. 4 is a sectional view schematically illustrating a developed image-bearing supporting member.
Figure 5:
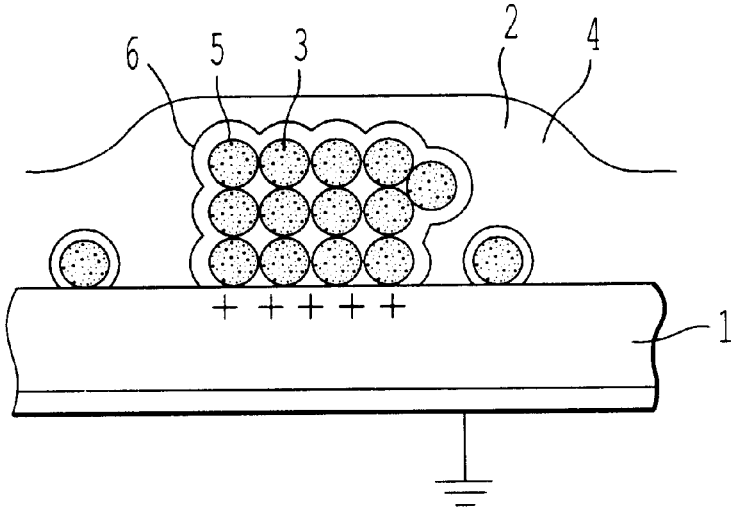
FIG. 5 is a sectional view schematically illustrating a developed image-bearing supporting member which has been subjected to a voltage impressing treatment.

FIG. 3 depicts a further embodiment of an image forming device for carrying out the process of the present invention. In this embodiment, black, cyan, magenta and yellow toner image forming stations 60–63 are arranged in tandem along an image transfer zone of an intermediate transfer belt 50. Each of the stations-60–63 includes a photosensitive drum 7, a cleaning roller 41, a cleaning blade 42, a quenching lamp 43, a corona discharge device 44, a developing roller 46, a squeezing roller 47, a voltage impressing roller 48 and a vessel 45 for containing a developing liquid of the corresponding color. Designated as 49 is a corona discharging device, 51 a transfer roller, 52 a transfer medium such as paper and 53 a cleaning web. A toner image on the drum 7 of each of the stations 60–63 is electrostatically transferred to the intermediate transfer belt 50. The transferred image on the belt 50 is in turn transferred to the transfer medium 52. Thus, even when the transfer medium 52 is low in surface smoothness, color solid patterns having uniform density can be obtained. The transfer roller 51 may be of a heating type or an electrostatic type.

The following examples will further illustrate the present invention. Parts are by weight.

Preparation of Developer:

| (1) Liquid Developer 1 | |
|---|---|
| Laurylmethacrylate/glycidylmethacrylate/ styrene copolymer (weight ratio: 60/30/10) | 30 parts |
| Pigment Red 12 | 10 parts |
| Isopar H | 70 parts |

The above ingredients were milled in a Kedy mill for 5 hours to obtain a negatively charged toner having an average particle diameter of 0.8 $\mu$m. The toner (50 g) were dispersed in 1,000 ml of Isobar H to obtain Liquid Developer 1.

| (2) Liquid Developer 2 | |
|---|---|
| Rosin-modified ester | 40 parts |
| Pigment Red 122 | 10 parts |
| Isopentyl myristate | 50 parts |
| Recithin | 0.1 part |

The above ingredients were milled in an attritor at 120° C. for 3 hours and then for 4 hours while being cooled to room temperature to obtain a toner having an average particle diameter of 1.8 $\mu$m. The toner (50 g) were dispersed in 1,000 ml of isopentyl myristate to obtain Liquid Developer 2.

| (3) Liquid Deveoper (3) | |
|---|---|
| Stearylmethacrylate/methacrylic acid copolymer (50/50 weight ratio) | 200 parts |
| Dimethylsilicone (KF96-300) | 500 parts |
| Pigment Red 146 (wet cake, solid matters: 50 weight %) | 200 parts |

The above ingredients were kneaded in a flusher to obtained a flushed pigment having Pigment Red 146 incorporated in the resin. 100 Parts of the flushed pigment, 200 parts of silicone oil KF95 and 0.5 part of polybutyrenemaleimide were milled in an attritor for 6 hours to obtain a toner. The toner (50 g) was dispersed in 1000-ml of silicone oil KF95 to obtain liquid developer (3).

Liquid Developer (4)

The above procedure for the preparation of Liquid Developer (1) was repeated in the same manner as described except that Pigment Yellow 95 was substituted for Pigment Yellow 12, thereby obtaining Liquid Developer (4).

Liquid Developer (5)

The above procedure for the preparation of Liquid Developer (2) was repeated in the same manner as described except that Pigment Red 2 was substituted for Pigment Red 122, thereby obtaining Liquid Developer (5).

Liquid Developer (6)

The above procedure for the preparation of Liquid Developer (3) was repeated in the same manner as described except that Pigment Red 38 was substituted for Pigment Red 146, thereby obtaining Liquid Developer (6).

EXAMPLE 1

Using an image forming device as shown in FIG. 1 and Liquid Developer (1), an image was formed on a paper having smoothness of 60 seconds. The surface potential on a photosensitive drum 7 was 900V. A voltage impressing roller 18 was made of hard alumite and was impressed with −1,000 V so that a discharge current of 10 μA flowed between the drum 7 and the roller 18. The roller 18 was disposed so that the roller 18 was not in contact with the liquid developer. An intermediate transfer member 9 is a belt of polyethylene terephthalate having a contact angle (measured by Ohken-type smoothness measuring device) of 4°.

The copy image obtained was measured for color density (by McBeath densitometer), resolution (number of lines per mm) and uniformity of solid pattern (rated as shown below) thereof.

5: excellent

4: good

3: fair

2: no good

1: poor

The results are summarized in Table 3.

EXAMPLE 2

Example 1 was repeated in the same manner as described except that a voltage of +1,000 V was applied to the voltage impressing roller 18. The results are summarized in Table 3.

EXAMPLE 3

Example 1 was repeated in the same manner as described except that a wire bar was substituted for the voltage impressing roller 18. The results are summarized in Table 3.

EXAMPLE 4

Example 1 was repeated in the same manner as described except that the voltage impressing roller 18 was maintained in contact with the developing liquid. The results are summarized in Table 3.

EXAMPLE 5

Example 1 was repeated in the same conditions as described except that an image forming device as shown in FIG. 2 was substituted for the device of FIG. 1 and that an intermediate transfer member 27 used was made of a silicone rubber having a contact angle of 10.5°. The results are summarized in Table 3.

EXAMPLE 6

Example 1 was repeated in the same conditions as described except that an image forming device as shown in FIG. 3 was substituted for the device of FIG. 1 and that an intermediate transfer belt 50 used was made of a fluororubber having a contact angle of 20°. The results are summarized in Table 3.

EXAMPLE 7

Example 1 was repeated in the same conditions as described except that an image forming device as shown in FIG. 3 was substituted for the device of FIG. 1 and that an intermediate transfer belt 50 used was made of a polyvinyl chloride having a contact angle of 5.0°. The results are summarized in Table 3.

EXAMPLE 8

Example 1 was repeated in the same manner as described except that Developing Liquid (2) was substituted for Developing Liquid (1). The results are summarized in Table 3.

EXAMPLE 9

Example 1 was repeated in the same manner as described except that Developing Liquid (3) was substituted for Developing Liquid (1). The results are summarized in Table 3.

EXAMPLE 10

Example 1 was repeated in the same manner as described except that a transfer paper having a surface smoothness of 10 seconds (the paper is less smooth than the paper used in Example 1) was used. The results are summarized in Table 3.

COMPARATIVE EXAMPLE 1

Example 1 was repeated in the same manner as described except that the voltage impressing roller 18 was omitted in the device shown in FIG. 1. The results are summarized in Table 3.

COMPARATIVE EXAMPLE 2

Example 1 was repeated in the same manner as described except that intermediate transfer member 9 was omitted in the device shown in FIG. 1 so that the toner image on the drum 7 was directly transferred to the paper. The results are summarized in Table 3.

COMPARATIVE EXAMPLE 3

Example 1 was repeated in the same manner as described except that the voltage impressing roller 18 and the intermediate transfer member 9 were omitted in the device shown in FIG. 1. The results are summarized in Table 3.

COMPARATIVE EXAMPLE 4

Comparative Example 1 was repeated in the same manner as described except that a transfer paper having a surface smoothness of 10 seconds was used. The results are summarized in Table 3.

COMPARATIVE EXAMPLE 5

Comparative Example 2 was repeated in the same manner as described except that a transfer paper having a surface smoothness of 10 seconds was used. The results are summarized in Table 3.

TABLE 3

| Example No. | Uniformity in Solid Pattern | Image Density | Resolution (number/mm) |
|---|---|---|---|
| 1 | 4 | 1.40 | 8.2 |
| 2 | 4 | 1.33 | 8.0 |
| 3 | 5 | 1.30 | 7.2 |
| 4 | 4 | 1.30 | 6.3 |
| 5 | 5 | 1.20 | 7.5 |
| 6 | 4 | 1.31 | 7.7 |
| 7 | 4 | 1.36 | 7.2 |
| 8 | 4 | 1.46 | 9.0 |
| 9 | 4 | 1.46 | 11 |
| 10 | 5 | 1.36 | 8.2 |
| Comp. Ex. 1 | 3 | 1.08 | 6.4 |
| Comp. Ex. 2 | 3.5 | 1.28 | 7.2 |
| Comp. Ex. 3 | 3 | 1.25 | 6.4 |
| Comp. Ex. 4 | 3.5 | 0.90 | 5.3 |
| Comp. Ex. 5 | 3 | 0.92 | 5.5 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An image forming process, comprising:

(a) contacting a latent image-bearing surface of a supporting member with a toner-containing liquid developer to develop said latent image with said liquid developer and to form a toner image covered with a layer of said liquid developer;

(b) treating a toner image-bearing surface with a squeezing member to squeeze said liquid developer layer therefrom; then (c) treating said toner image-bearing surface with a voltage impressing member to impart a bias voltage to said toner image; then (d) transferring said toner image from said surface to an intermediate transfer medium; and then (e) transferring said transfer toner image from said intermediate transfer medium to a transfer medium.

2. The process as claimed in claim 1, wherein said squeezing member is a squeezing roller rotating in one direction and wherein said voltage impressing member is a voltage impressing roller rotating in a direction opposite said one direction.

3. The process as claimed in claim 2, wherein said voltage impressing roller is spaced apart from said toner image-bearing surface to define a gap therebetween.

4. The process as claimed in claim 3, wherein said gap is greater than a space between said toner image-bearing surface and said squeezing roller.

5. The process as claimed in claim 1, wherein said intermediate transfer medium has a surface with a contact angle with water of 3° to 180°.

6. The process as claimed in claim 1, wherein step (c) comprises impressing to said toner image-bearing surface a voltage of a polarity opposite the polarity of said toner image to permit a discharge current of 1–100 $\mu$A to flow between said voltage impressing member and said toner image-bearing surface.

7. The process as claimed in claim 1, wherein step (d) is by pressure, heat, electrostatic force or a combination thereof.

8. The process as claimed in claim 1, wherein step (e) is by pressure, heat, electrostatic force or a combination thereof.

9. The process as claimed in claim 1, wherein said toner contains a coloring agent selected from the group consisting of disazo yellow pigments as a yellow coloring agent, carmine and quinacridone pigments as a magenta coloring agent, phthalocyanine pigments as a cyan coloring agent, and carbon black as a black coloring agent.

10. The process as claimed in claim 9, wherein said toner contains a resin selected from the group consisting of acrylic resins, rosin-modified resins, silicone resins, polyolefin resins and polyurethane resins.

* * * * *